US007181864B1

(12) United States Patent
Coss

(10) Patent No.: US 7,181,864 B1
(45) Date of Patent: Feb. 27, 2007

(54) DEHYDRATION OF BODY HEM FLANGES

(75) Inventor: Chris Coss, Oxford, AL (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/278,272

(22) Filed: Mar. 31, 2006

(51) Int. Cl.
*F26B 7/00* (2006.01)

(52) U.S. Cl. ..... 34/380

(58) Field of Classification Search ..... 34/266, 34/267, 270, 380, 666; 432/175; 438/239
See application file for complete search history.

(56) References Cited

U.S. PATENT DOCUMENTS 3,817,697 A * 6/1974 Parobek ..... 432/105
4,683,664 A * 8/1987 Codenotti ..... 34/479
4,829,620 A 5/1989 Christ et al.
4,903,509 A 2/1990 Christ et al.
5,598,643 A 2/1997 Chuang et al.
6,062,850 A * 5/2000 Ino et al. ..... 432/143
6,640,642 B1 11/2003 Choi et al.
6,872,616 B2 * 3/2005 Iwaida et al. ..... 438/239
7,097,876 B2 * 8/2006 Tojo et al. ..... 427/156
2001/0054432 A1 * 12/2001 Olashuk ..... 134/10
2003/0037874 A1 2/2003 Liau et al.
2003/0099275 A1 5/2003 De Aguiar et al.

* cited by examiner

*Primary Examiner*—S. Gravini
(74) *Attorney, Agent, or Firm*—Rankin, Hill, Porter & Clark LLP; Vincent Ciamacco

(57) ABSTRACT

As a metal assembly, which defines partially open voids in which liquid accumulates is conveyed through a heat-treating station, the hot air is blown across the open end of the void to produce a zone of low pressure at the surface of the liquid. The reduction in pressure and relatively high temperature promote rapid vaporization of the liquid while discouraging boiling of the liquid.

6 Claims, 3 Drawing Sheets

DEHYDRATION OF BODY HEM FLANGES

FIELD OF THE INVENTION

The present invention generally relates to the heat treating and coating of fabricated sheet metal components as they move along an assembly line and, more particularly, to a method for removing liquid contaminants from partially closed voids in fabricated sheet metal assemblies where the liquid results from the assemblies being dipped in or sprayed with various cleaning and treating liquids prior to heat treating and coating processes.

BACKGROUND OF THE INVENTION

In the manufacture of various sheet metal components, such as in the production of vehicles, a fabricated assembly is often subjected to heat treatment at temperatures in excess of 100° C. subsequent to coating such as by dipping or spraying. In certain portions of these assemblies, such as automobile body assemblies, door frames, and the like, the assembly is formed to provide a hem flange along one or more edges in order to strengthen the frame structure. A hem flange is formed by bending an edge portion of the panel inwardly about 180° so that the bent-in portion is folded back along the adjacent panel margin. This forms an open slot. Usually, another sheet metal piece, often called a stiffener, has a matching portion placed in the slot. This may then be spot-welded.

The frame portion with the hem flange so formed is subsequently passed through one or more dip tanks for cleaning purposes. The liquids used in the tank may include phosphate solutions, permeates and rinse water for example. This treatment may leave liquid contaminants on the panel surfaces, as well as in partially exposed voids such as those contained in hem flanges.

Most of these liquid contaminants are removed at a drying station along the assembly line. However, where the liquid has accumulated in voids, such as in a hem flange, the drying process is often not complete. Thus, when the frame assembly is passed through a heat-treating station with temperatures in excess of 100° C., the liquid may boil off and leave defects on one or more surfaces that must be removed by a manual procedure, such as sanding. Obviously, this is unsatisfactory and should be avoided.

Boiling off of the liquid contaminants occurs because the particular volume of liquid is heated to a temperature at or above its boiling point at the prevailing atmospheric pressure. When this occurs, the saturated vapor pressure within the volume of liquid equals the surrounding atmospheric pressure. Thus, the temperature of the liquid itself causes bubbles of vapor to form within the volume of liquid and then escape to the atmosphere. Boiling continues until the entire volume of liquid is converted to vapor. This results in defects on frame assembly surfaces as described above.

On the other hand, where the vapor pressure inside the volume of liquid is less than the pressure of the surrounding atmosphere (i.e. below the boiling point) then bubbles will not form and only ordinary evaporation will occur. Since ordinary evaporation is the preferred way to remove liquid contaminants, it would be desirable to keep the temperature of the liquid contaminant below the boiling point, but at a relatively high temperature to encourage evaporation.

The rate of evaporation is a function of temperature and pressure. The optimum rate of evaporation (without boiling) occurs when the temperature is relatively high and the pressure is relatively low. In the heat-treating process, the temperature must be at or above the boiling point and the atmospheric pressure is normally not adjustable.

Efforts have been made to remove these contaminants before they boil off in the heat-treating process, but the methods tried have significant disadvantages. Among the techniques tried are: (1) seal welding along all hem flanges, (2) applying an expandable weld sealer, (3) blowing compressed air into the flanges, and (4) shaking the panel during its travel along a conveyor. The first two techniques are cost-prohibitive and the last two have not been successful.

Accordingly, a need exists for a reliable and cost effective method of removing liquid accumulations from voids in hem flanges, before they boil off in the heat-treating process.

SUMMARY OF THE INVENTION

In accordance with the present invention, the rapid evaporation of liquid contaminants from partially exposed voids is accomplished by reducing the air pressure in a zone immediately surrounding the surface of the liquid contaminant so that the boiling point is increased as a function of the reduced pressure. Accordingly, the air temperature in the zone may be at or slightly greater or less than the boiling point in the surrounding atmosphere without boiling occurring.

This is accomplished by directing a flow of heated air at a relatively high velocity across, or in the vicinity of, the open portion of the void. This produces a pressure gradient and thus creates a zone of reduced pressure at the surface of the liquid. By heating the metal structure containing the void to a high temperature, an optimum evaporation rate can be obtained without any boiling occurring.

The high velocity airflow is produced by forcing air through one or more nozzles aimed at the location on the structure that contains the void or voids where liquid contaminants accumulate. The resulting reduction in pressure at the surface of the liquid, combined with the high ambient temperature, promotes rapid vaporization of the liquid without any boiling.

The invention is particularly useful in the production of vehicle body assemblies fabricated of sheet metal and having hem flanges at door frames and other locations.

In a preferred form of the invention, the method is used along a vehicle body assembly line wherein the bodies are dipped in one or more tanks of cleaning liquid such as phosphate solutions and rinse water. In these circumstances the heated, high velocity airflow is used in a pre-heat step prior to a subsequent heat-treating or curing process.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
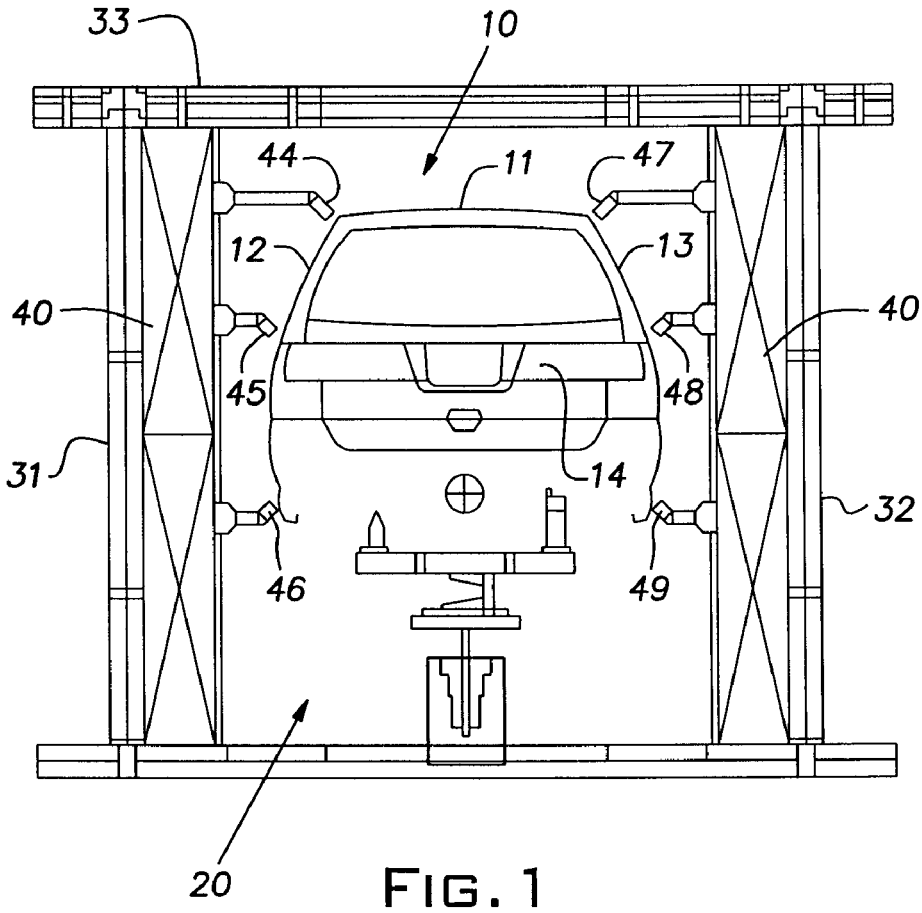
FIG. 1 is an elevational view, partly in diagrammatic form, showing a portion of a assembly line pre-heating tunnel adapted for use in practicing the method of the invention, with an automotive vehicle body being transported therethrough.

Referring more particularly to the drawings and initially to FIG. 1, there is shown a vehicle body assembly 10 fabricated from sheet metal and being conveyed through a pre-heating tunnel 20, adapted to perform the method of the invention in order to cause evaporation of liquid contaminants. The method of the invention is used simultaneously with the pre-heating of the body assembly 10, as is necessary prior to heat treating of the body assembly, as is well known in the art.

Figure 5:
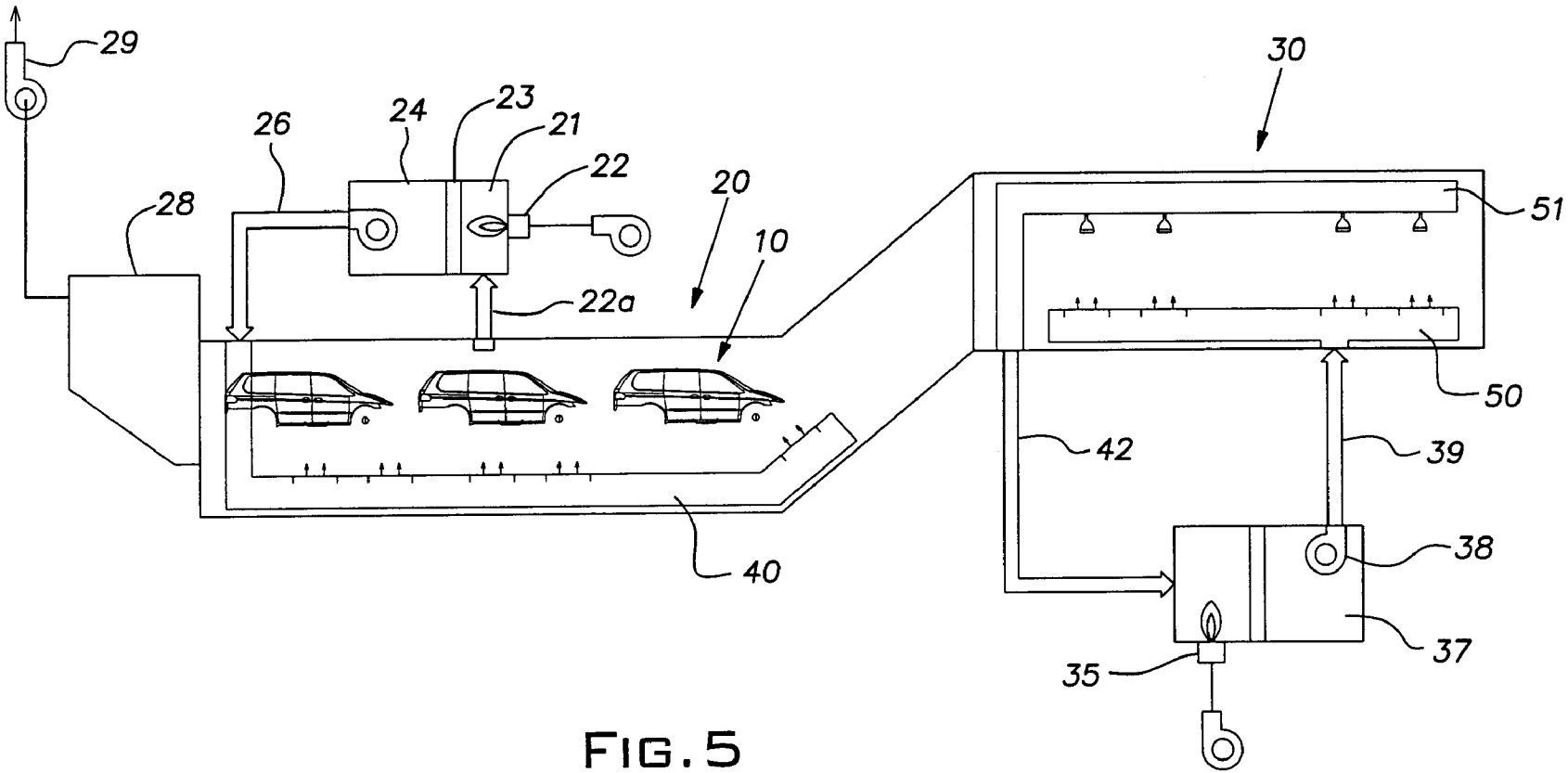
FIG. 5 is diagram showing a portion of an assembly line for vehicle frame assemblies, the assembly line including the heat-treating tunnel shown in FIG. 1.

In this regard, FIG. 5 schematically shows both the pre-heat tunnel 20 and a downstream heat-treating tunnel 30. After being dipped in a tank containing, for example, a cleaning solution, the body assembly 10 (which is sometimes referred to as a 'white body' by those skilled in the art) is carried into the pre-heat tunnel 20. In the pre-heat tunnel 20 the body assembly 10 is gradually heated to an elevated temperature before being introduced into the heat-treating tunnel 20, in which the body assembly temperature is raised to a desired heat-treating temperature. For example, in the pre-heat tunnel 20 the temperature of the body assembly 10 may be raised to between about 65–95° C., whereas, in the heat-treating tunnel 30, the temperatures are preferably between 150–175° C.

Figure 2:
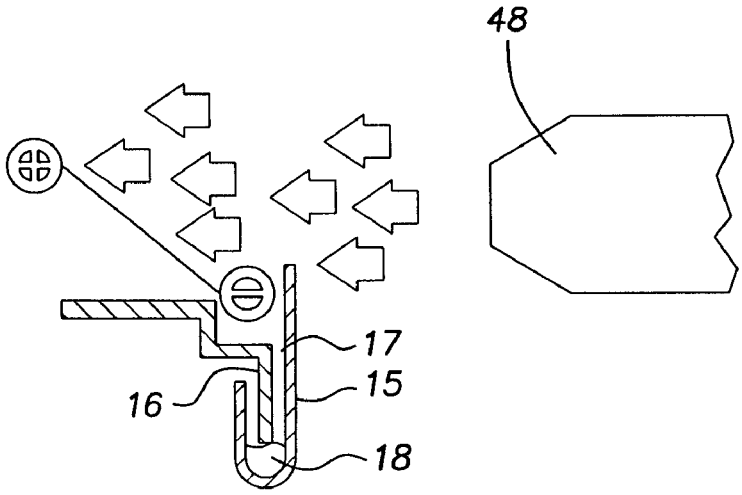
FIG. 2 is a diagrammatic view on an enlarged scale illustrating a hem flange with a partially open void containing a small volume of a liquid contaminant, and illustrating application of heated pressurized air to encourage evaporation of the liquid contaminant.
Figure 4:
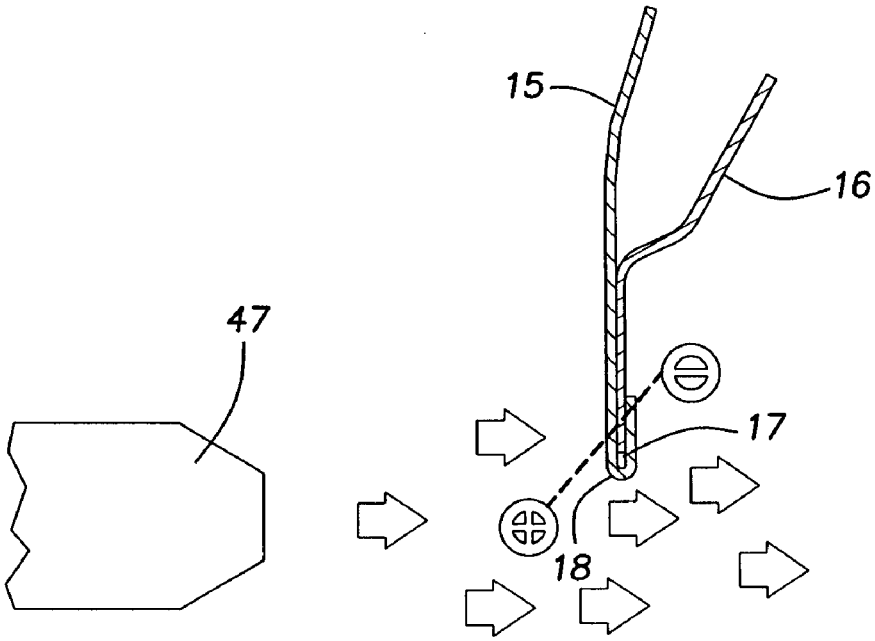
FIG. 4 is a sectional view as seen along line 4—4 of FIG. 3, and illustrates application of heated air to evaporate liquid from the hem flange.

The body assembly 10 includes a roof panel 11, side panels 12 and 13, and a rear panel 14. Around the opening defined by the door frame, hem flanges 15, such as illustrated in FIGS. 2 and 4, are formed to provide increased strength. A hem flange is formed by bending an edge portion of the side panel 13 inwardly about 180° so as to form an open slot. Then, a stiffener 16 is inserted in the slot and spot welded to provide reinforcement. The resulting structure defines one or more partially open voids 17 that may trap a volume of liquid contaminant 18.

The pre-heating tunnel 20 defines a heating chamber through which frame assemblies 10 are continuously conveyed. The pre-heat tunnel 20 is relatively long, and may simultaneously receive between 4–6 body assemblies 10 one after another. A gas fired heater 22 heats a volume of air that flows into an inlet chamber 23. From the inlet chamber 23, the heated air passes through a filter 24 into an outlet chamber 25. The filtered air is then driven by a centrifugal blower 26 through a supply duct 27 and into a distributor 28 that communicates with manifolds 40, 41 disposed in the pre-heat tunnel 20.

The air is exhausted from the tunnel 20 by means of an exhaust blower 29 so as to create counter-current of heated air in which the body assemblies 10 move. Recirculated heated air is provided to the heater 22 via a return 22*a*. The resulting flow of heated air in the tunnel 20 raises the temperature of the body assembly 10, or in other words, pre-heats the bodies before they reach the heat-treating tunnel 30.

Similarly, in the heat-treating chamber or tunnel 30, air to be heated enters a heating chamber 34 where it is heated by a gas-fired heater 35. The heated air passes through a filter 36 into an air supply chamber 37. From the air supply chamber 37 the heated air is driven by a centrifugal blower 38 into an air supply duct 39. A manifold 50 receives heated air from the air supply duct 39. Air from the tunnel 30 is drawn into a return manifold 41 and then returned to the heating chamber 34 through a return duct 42.

FIGS. 1 and 5 show the vehicle body assembly 10 in the pre-heating tunnel 20. As is known in the art, due to the large mass of the vehicle body assembly 10, it takes time and energy to raise the body temperature toward the desired heat treating temperature. Thus, the temperature of the body assembly 10 is gradually increased as it traverses the pre-heating tunnel 20 and is further increased as it moves through the heat-treating tunnel 30.

The pre-heating tunnel 20 has side walls 31 and 32 and a roof 33 to confine a flow of heated air. The distributor 28 connects to the distributor manifold 40 located in the tunnel 20, the manifold 40 being adapted to provide a uniform distribution of heated air to the body assemblies being conveyed therepast. Preferably, the manifold extends along the length of the tunnel 20 (i.e., along the sidewalls 31, 32) and along each side of the body assemblies 10, as illustrated.

Figure 3:
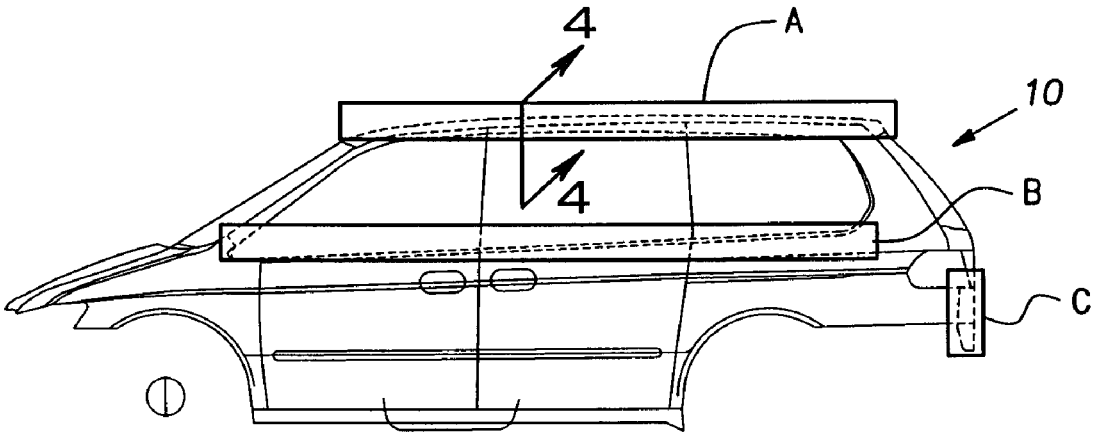
FIG. 3 schematically illustrates a vehicle and highlights problem areas where liquid contamination of the hem flanges may occur.

In accordance with the invention a suitable number of air nozzles 44, 45, 46, 47, 48 and 49 are positioned in the tunnel 30 and are aimed at the hem flanges from which liquid contaminants are to be removed by evaporation. As shown in FIG. 3, problem zones A, B, and C, wherein liquid contamination of the hem flanges is problematic, exist on the body assembly 10. The upper nozzles 44, 47 are directed toward the upper zone A; the mid nozzles 45, 48 are directed toward the middle zone B; and the lower nozzles 46, 49 are directed toward the lower zone C. In one embodiment of the invention, the nozzles 44–49 are placed about every 1.5–2 feet along the length of the tunnel 20. In this embodiment, about forty of each nozzle were used, although more or less than this number could also be used with similar results. Naturally, more or less than three zones (and correspondingly more or less than three rows of nozzles) may be presented.

For the purpose of illustration only the operation of the nozzle 48 will be discussed. This nozzle is aimed at the hem flange 15 located in the door frame formed in the side panel 13 as shown in FIG. 2.

As the hem flange 15 moves past the nozzle 48, a high velocity flow of heated air is directed as shown in FIG. 2, across the portion that defines the open part of the void 17. The effect of the high velocity flow produces a pressure gradient from the ambient pressure, identified by the symbol ⊕, to a zone of reduced pressure, identified by the symbol ⊖, in the vicinity of the void. As a result, the zone of reduced pressure ⊖ extends across the surface of any liquid contaminant contained therein. Because the reduced pressure raises the boiling point, the liquid will evaporate at a rapid rate before any boiling can occur. Thus, in the present invention the heated air used to preheat the body assembly 10 is also used to evaporate the liquid contamination without causing boiling thereof, thereby improving the manufacturing process without increasing costs or cycle time.

FIG. 4 shows a similar arrangement of the hem flange 15 and the nozzle 47. However, in FIG. 4 due to the placement of the hem flange 15, the heated air supplied by the nozzle 47 moves across the closed end of the hem flange. Nevertheless, a pressure gradient is produced by the flow of heated air, and the liquid contaminants 18 in the hem flange are vaporized without boiling.

The number of nozzles needed and their location in the pre-heating tunnel 20 will depend on the nature of the assembly line and the particular vehicle body assembly involved. Further, while the present invention is described herein as being used in the pre-heating portion of the assembly line, it is considered apparent that it could, instead or in addition, be implemented in the heat treating portion.

While the invention has been shown and described with respect to a particular application of the method of the invention, this is intended for the purpose of illustration rather than limitation and other variations and modifications of the specific method herein shown and described will be apparent to those skilled in the art. Accordingly, the invention is not to be limited in scope and effect to the specific method herein shown and described, nor in any other way that is inconsistent with the extent to which the progress in the art has been advanced by the invention.

What is claimed is:

1. A method for removing a liquid contaminant from a partially open void in a fabricated metal assembly comprising:

conveying the assembly through a heated environment;

simultaneously blowing hot air at a relatively high velocity adjacent to the partially open void;

producing a pressure gradient near the partially open void creating a reduced pressure zone at a surface of the liquid contaminant disposed within the partially open void;

producing a high evaporation rate as a result of the reduced pressure zone; and evaporating the liquid contaminant without boiling.

2. The method as defined in claim 1, wherein the metal assembly is conveyed through a heated tunnel and wherein the heated atmosphere being blown is supplied through a fixed nozzle aimed at a location through which the partially open void will pass while moving through the tunnel.

3. The method as defined in claim 2, wherein the metal assembly is heated in the tunnel to about the boiling point of the liquid contaminant.

4. The method as defined in claim 2, wherein the metal assembly is a vehicle body assembly.

5. The method as defined in claim 4, wherein the partially open void is formed by a hem flange in the automotive vehicle frame assembly.

6. The method as defined in claim 1, wherein the hot air is blown across the open portion of the partially open void.

* * * * *